US006226810B1

(12) United States Patent
Weddendorf et al.

(10) Patent No.: US 6,226,810 B1
(45) Date of Patent: May 8, 2001

(54) PORTABLE BATH SEAT

(75) Inventors: Bruce Weddendorf, Huntsville; Gary J. Helmes, Sr., Union Grove, both of AL (US)

(73) Assignee: Patent/Marketing Concepts, L.L.C., Boaz, AL (US)

( * ) Notice: Subject to any disclaimer, the term of this patent is extended or adjusted under 35 U.S.C. 154(b) by 0 days.

(21) Appl. No.: 09/401,858

(22) Filed: Sep. 22, 1999

(51) Int. Cl.[7] ..... A47K 3/022

(52) U.S. Cl. ..... 4/579; 4/578.1; 4/447; 4/448

(58) Field of Search ..... 4/578.1, 579, 567, 4/571.1, 573.1, 575.1, 559, 560.1, 561.1, 562.1, 605, 443, 444, 447, 448

(56) References Cited

U.S. PATENT DOCUMENTS

| | | | | |
|---|---|---|---|---|
| 1,076,808 | | 10/1913 | Arburg . | |
| 1,197,657 | * | 9/1916 | Orofino | 4/579 |
| 2,052,628 | | 1/1936 | Higgins . | |
| 2,237,076 | * | 4/1941 | Kenney et al. | 4/579 |
| 2,678,083 | * | 5/1954 | Dall et al. | 4/578.1 |
| 2,753,570 | * | 7/1956 | Evans | 4/448 |
| 3,203,008 | * | 8/1965 | Murcott | 4/560.1 |
| 4,150,445 | | 4/1979 | Bailey . | |
| 4,168,549 | | 9/1979 | Davies . | |
| 4,359,791 | | 11/1982 | Thomas . | |
| 4,391,006 | | 7/1983 | Smith . | |
| 4,472,844 | | 9/1984 | Mace . | |
| 4,520,515 | | 6/1985 | Hatala . | |
| 5,263,207 | | 11/1993 | Gilbert . | |
| 5,341,525 | * | 8/1994 | Tillman et al. | 4/579 |
| 5,373,591 | | 12/1994 | Myers . | |
| 5,606,751 | * | 3/1997 | Baker | 4/560.1 |
| 5,784,728 | | 7/1998 | Weddendorf . | |

* cited by examiner

*Primary Examiner*—Steven O. Douglas
*Assistant Examiner*—Khoa Huynh
(74) *Attorney, Agent, or Firm*—Dowell & Dowell, P.C.

(57) ABSTRACT

A lightweight portable seating unit for a bathtub which unit includes a platform adapted to be supported by and clamped to the sidewalls of the bathtub and on which a seat is slideably carried and pivotably adjustable to facilitate positioning of an individual seated on the unit. In some embodiments the seat may include an adjustable backrest and head support and/or a bidet attachment.

21 Claims, 8 Drawing Sheets

PORTABLE BATH SEAT

BACKGROUND OF THE INVENTION

1. Field of the Invention

The present invention is directed to bath seats which are utilized to support an individual in a bathtub and more particularly to bath seats which are designed to be compactly folded for portability and storage and which are light weight thereby facilitating handling and use.

2. Brief Description of the Related Art

There are many people who because of age or physical disability require assistance when using a shower or bathtub. often, such individuals must be supported on a seating unit which is provided specifically for use with a bathtub or shower enclosure. Because of this, it often becomes necessary for an aide, nurse or family member to exert a great deal of physical effort to lift and lower an individual into a bathtub or to lift an individual onto a seating unit position within the bathtub or shower. A number of prior art seating devices have been designed to alleviate such physical effort.

Some prior art structures have been designed to be permanently installed adjacent to a bathtub or shower enclosure. Unfortunately, such permanently installed structures are often not practical especially when individuals travel, visit with friends or family or when the size of the bathroom does not permit such permanent installation. Examples of this type of seating unit or support device are disclosed in U.S. Pat. No. 1,076,808 to Arborg, U.S. Pat. No. 2,052,629 to Higgins and U.S. Pat. No. 5,263,207 to Gilbert.

Other bathtub seating units include very basic structures which are designed to include bench-like surfaces for supporting an individual within a bathtub. Unfortunately, such bench-type seats require that an individual either seat themselves on the bench within the bathtub or be lifted and placed on the bench. If an individual does not have the physical ability to seat him or herself, it is generally not practical to use a fixed bench-type seating unit for a bathtub or shower enclosure.

To facilitate the positioning of an individual on a bath chair or seat, some bench-type supports have been designed which include cantilevered portions which extend from the sidewall of the bathtub or enclosure. Such portions provide initial support for an individual being assisted. After an individual is seated on a cantilevered seat, the individual may thereafter be moved so that they are positioned between the sidewalls of the bathtub or shower enclosure. Examples of such bathing support devices are disclosed in U.S. Pat. No. 4,391,006 to Smith, U.S. Pat. No. 4,472,844 to Mace and U.S. Pat. No. 4,520,505 Hatala.

Some seating devices for use with bathtubs have been designed to be more portable in nature. In U.S. Pat. No. 4,359,791 to Thomas, a slidable seat is disclosed which is mounted on a frame having a pair of legs supported by a bathtub and a pair of legs which are engageable with a floor exteriorly of the bathtub. The overall structure, however, is not securely positioned on the bathtub and can be displaced when in use. Additional examples of bathtub seating devices are disclosed in U.S. Pat. No. 4,168,549 to Davies, U.S. Pat. No. 5,373,591 to Myers and U.S. Pat. No. 4,150,445 to Bailey.

An improvement over prior art portable bath seating units is disclosed in U.S. Pat. No. 5,784,728 to Weddendorf et al. The bathing unit disclosed includes a frame which is designed to be mounted to the upper walls of a bathtub or shower enclosure. A carriage is moveably mounted to the frame such that a chair carried by the carriage may be moved from a first position which allows an individual to be seated upon the chair above the outer sidewall of bathtub and, thereafter, the chair pivoted on the carriage and the carriage moved so that the seat is positioned within the bathtub or shower enclosure. The frame is stabilized by a pair of foldable legs which engage a bottom wall of the bathtub and a pair of front clamps which engage over the outer sidewall of the bathtub. Although the seating unit disclosed in this patent exhibits an improvement over prior art portable bath seating units, the use of the carriage for supporting the seat and the support structure for the main frame add both to the cost of the unit as well as the bulk and weight of the unit which in some degree, has an effect on portability and handling of the seating unit.

In view of the foregoing, there remains a need to provide lightweight, sturdy, and portable bath chairs or seats which may be easily and compactly transported and stored when not in use but which may be readily and securely mounted to a bathtub or bathtub enclosure to provide a safe support for an individual requiring the use of a seating device when bathing or showering.

SUMMARY OF THE INVENTION

The present invention is directed to a lightweight portable seating unit for use with a bathtub or shower enclosure which includes a platform having an outer or first end portion which is designed to be seated upon an outer sidewall of a bathtub while an inner or second end is supported by a pivotably leg assembly which is engageable with a bottom wall of the bathtub. The platform is secured to the bathtub by an adjustable clamp assembly including oppositely oriented clamp members which are pivotal from a stored position beneath the platform to a deployed position engageable with opposite surfaces of the outer wall of the bathtub. The pivotable leg assembly is moveable between a first stored position beneath the platform to a deployed position wherein the legs provide support for the inner end of the platform. A lock is provided for retaining the leg assembly in either the stored or deployed position. A carrying handle for the seating unit is pivotably mounted to the platform adjacent the clamp assembly and, when moved from a toting or carrying position to a position beneath the platform, is operative to cam one of the clamp members of the clamp assembly tightly against a side wall of the bathtub.

The invention further includes a seat which is slideably supported on roller bearings on the platform and is guided within a slot formed in the platform. The seat may be rotated at an inner portion of the slot. An individual may be seated on the seat exteriorly of the bathtub, afterwhich, the seat is moved along the platform such that the individual is seated between the sidewalls of the bathtub. Thereafter, the seat is rotated to reorient the seat relative to the platform. The invention may include a locking device to retain the seat in a deployed position when in use so that the seat cannot shift relative to the platform on which it is supported.

In a further embodiment of the present invention, a bidet-like device may be attached to a modified seat to further provide for a thorough cleansing of an individual on the seating unit. The first modified seat includes recesses in a base and backrest into which the bidet device is frictionally fitted.

In some embodiments of the invention, a tray is detachably mounted to the inner end of the platform so as to be situated generally over an inside wall of the bathtub. The tray may include openings for draining water during use.

A further seat modification is provided which is designed to permit varying degrees of patient reclining as well as patient head support. In this embodiment, the seat includes a backrest which is adjustable to vary its tilt angle. When not in use, the backrest is folded against the seat bottom. A head rest is telescopically mounted to the backrest and may include a strap for securely retaining a patient's head to the headrest. To provide additional stability to the seating unit when the modified seat is in use, a bracket is provided which is engageable with the platform and which extends therefrom to engagement with an endwall of a bathtub in the direction of the tilt angle of the backrest.

It is the primary object of the invention to provide a portable bath seat which is extremely lightweight and compact thereby facilitating portability and deployment for use and yet which is sturdy enough to support larger individuals requiring assistance when bathing or showering.

It is also an object of the invention to provide a portable bathing unit which includes a seat which is maneuverable from a first position where an individual may be seated while they are exterior of a bathtub or shower enclosure to a second position wherein the seat is rotatable within the bathtub or shower enclosure.

It is another object of the invention to provide a portable bath seating unit which includes a platform which sideably supports a seat including roller bearings and wherein the platform is supported by legs which are pivoted from a stored position beneath the platform to a deployed position where the legs engage a bottom surface of a bathtub or shower enclosure.

It is another object of the invention to provide a portable seat assist device for use with bathtubs and shower enclosures wherein the seating unit may be adapted to retain a fluid discharge bidet-device for facilitating patient cleansing.

It is a further object of the invention to provide a portable bathing unit which includes structure to permit a patient to be seated at various tilt angles without the unit becoming unstable and wherein a patient's head can be stabilized.

It is also an object of the invention to provide a portable bath seat which can be securely clamped to a bathtub using cam leverage provided by a carrying handle associated therewith.

BRIEF DESCRIPTION OF THE DRAWINGS

A better understanding of the invention will be had with respect to the drawing figures wherein.

DESCRIPTION OF THE PREFERRED EMBODIMENT

With continued reference to the drawings, the portable lightweight bathtub seating unit 10 of the present invention is shown as being mounted to an outer side wall 12 of a bathtub 13. Although the seating unit is shown as being supported by only an outer wall of the bathtub, the seat can be utilized in enclosures where there is a ledge provided on the inside wall 11 of the bathtub.

Figure 1:
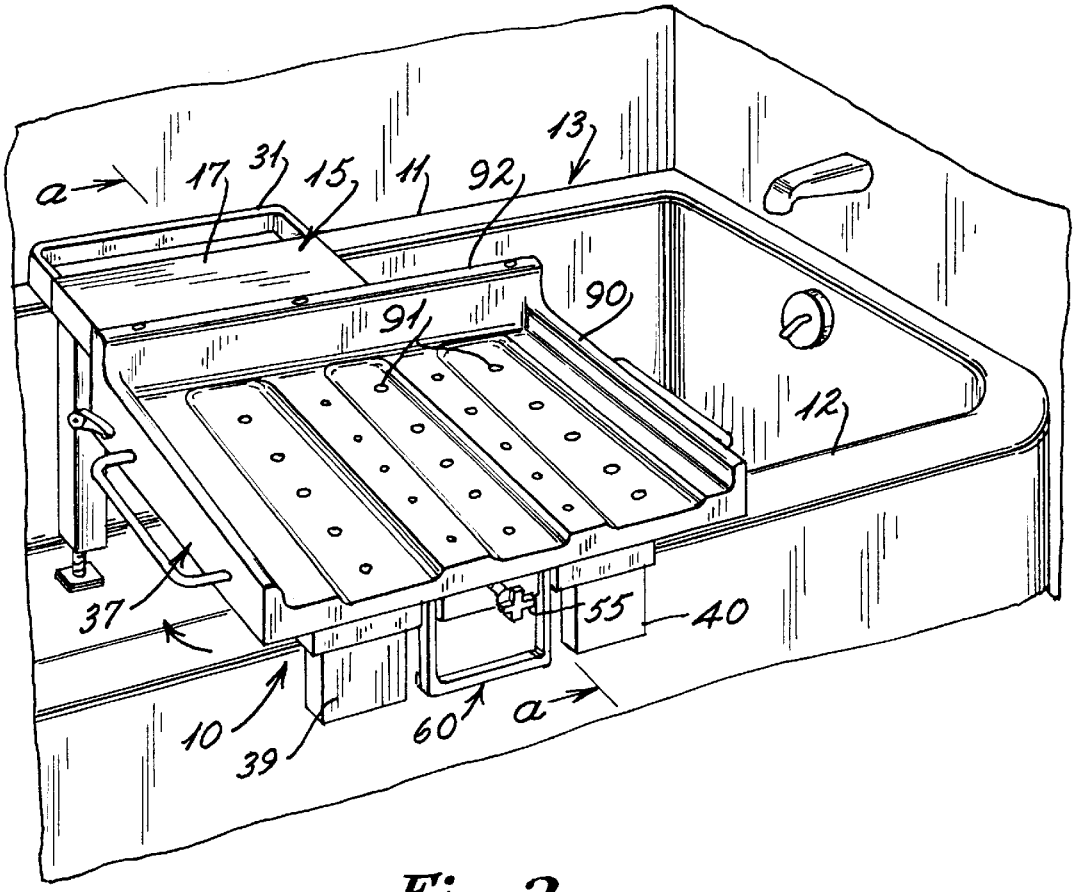
FIG. 1 is a front perspective illustrational view of the portable bath seat of the invention shown mounted to an outer sidewall of a bathtub.
Figure 3:
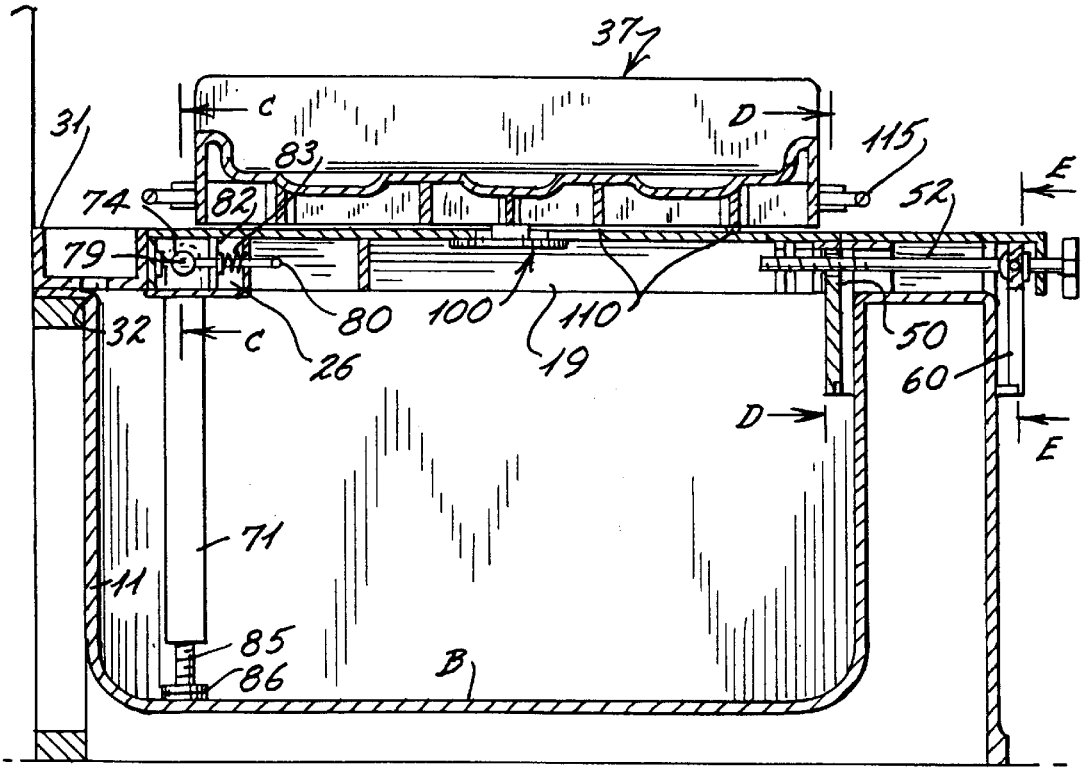
FIG. 3 is a cross-sectional view taken along lines A—A of FIG. 1.
Figure 4:
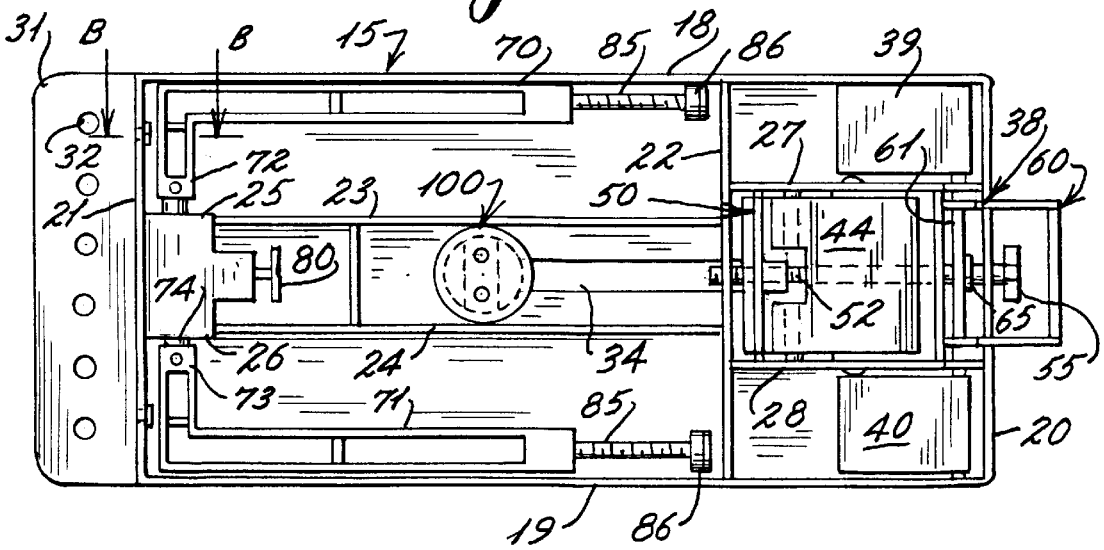
FIG. 4 is a bottom plan view of the bath seat shown in FIG. 1.
Figure 12:
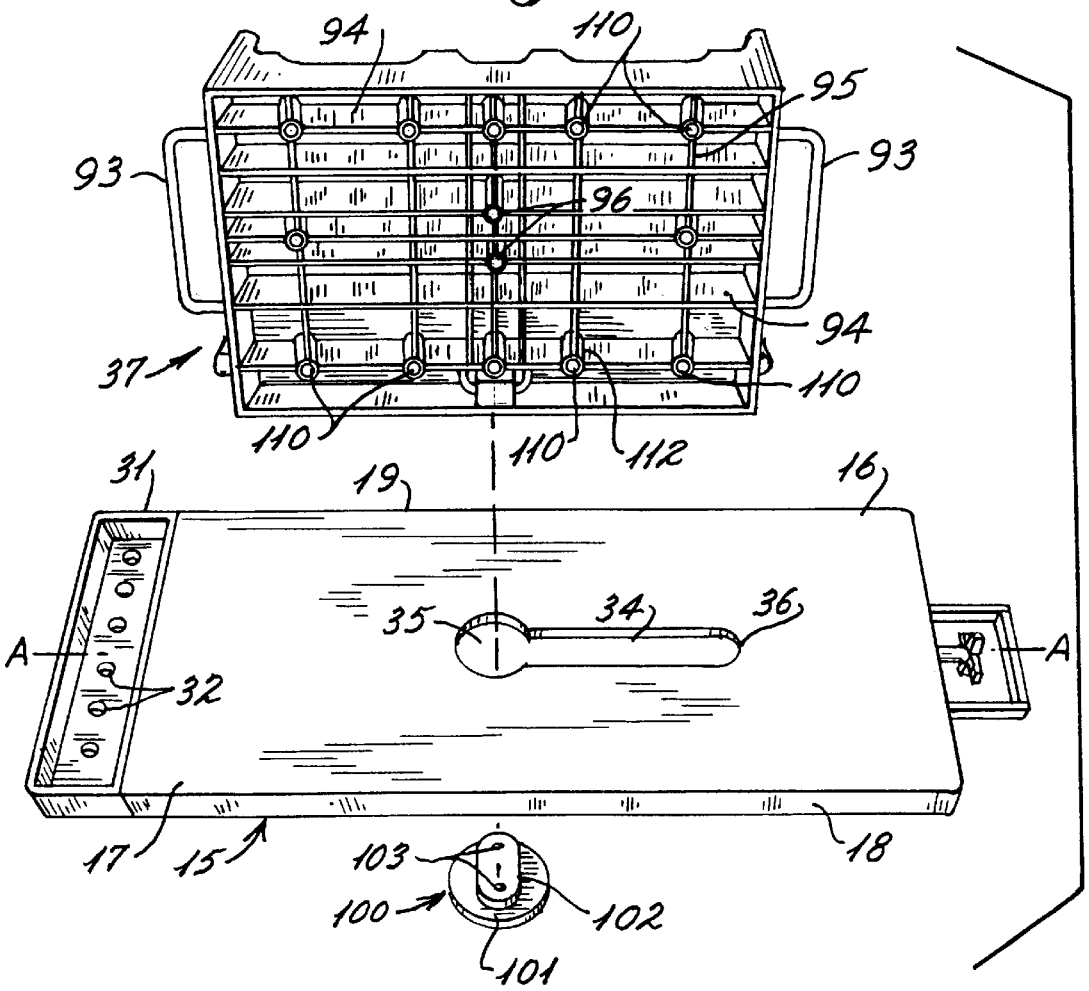
FIG. 12 is a partial assembly view of the bath seat of FIG. 1.
Figure 13:
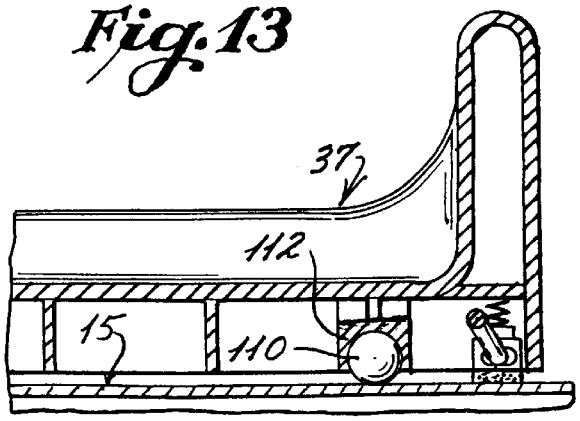
FIG. 13 is a partial cross-sectional view taken along line I—I of FIG. 2 showing a roller bearing for supporting the seat of the invention.

The seating unit includes a platform 15 which is shown in FIGS. 1 and 12 as being generally rectangular in configuration having a first end portion 16 adapted to be positioned adjacent the outer wall 12 of the bathtub and a second end portion 17 adapted to be positioned adjacent to but normally spaced from the inner wall 11 of the bathtub. The first end portion 16 is also shown as being cantilevered outwardly beyond the outer wall 12 of the bathtub. The platform is preferable molded from a plastic material which is reinforced by opposite sidewalls 18 and 19 and front and rear wall 20 and 21, as shown in FIG. 4. Further reinforcing is provided by a web 22 which extends between the sidewalls 18 and 19 and a pair of longitudinal webs 23 and 24 which extend from the web 22 toward the second end portion 17 of the platform. The rear portion of webs 23 and 24 are connected by a closure panel 25 so as to create an enclosed housing 26, as shown in FIGS. 3 and 4. The first end portion 16 of the platform is further reinforced from the bottom by spaced webs 27 and 28 which also serve as guides for a clamping mechanism to be described in greater detail hereinafter. The webs are connected by opposed walls 29 and 30 which, together with the webs 27 and 28, form a slide housing.

Figure 15:
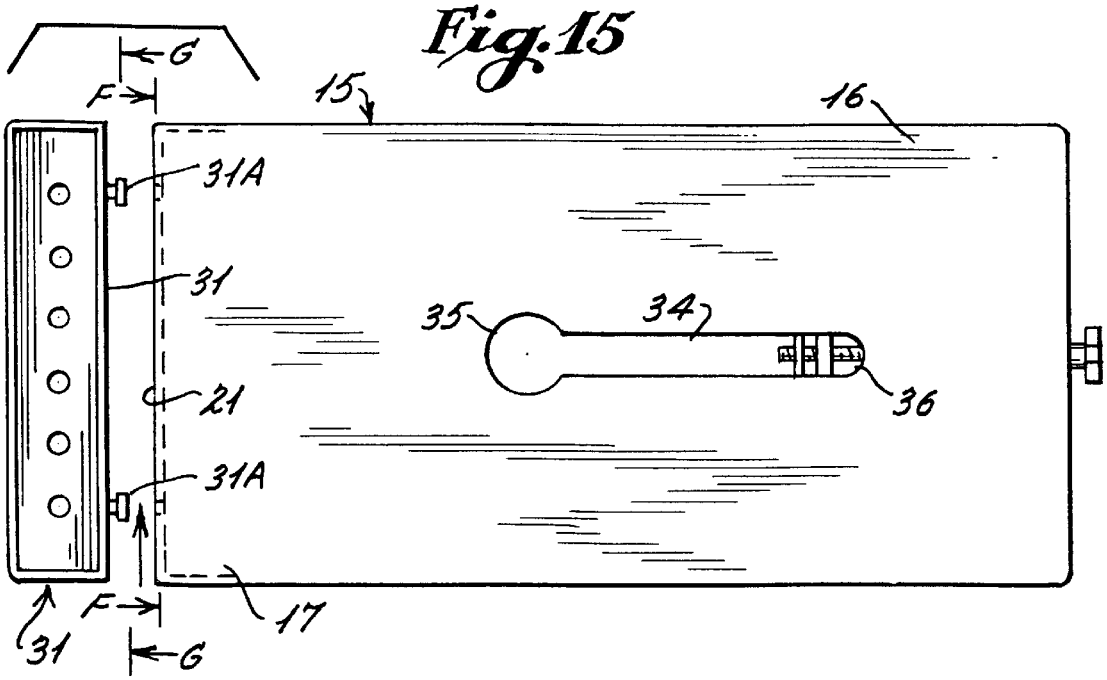
FIG. 15 is a top plan assembly view of an embodiment of the invention incorporating a removable storage tray.
Figure 16:
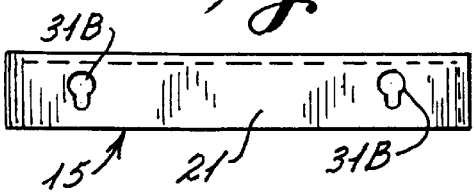
FIG. 16 is a view taken along line F—F of FIG. 15.
Figure 17:
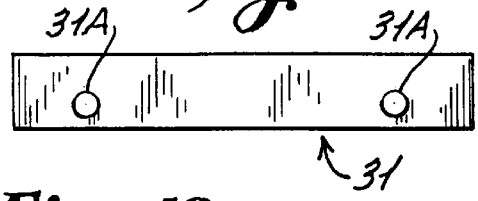
FIG. 17 is a view taken along line G—G of FIG. 15.

As shown in FIGS. 3 and 15, a tray 31 is removably mounted to the end portion 17 of the platform for purposes of supporting soaps, shampoos, creams, sponges and the like which may be utilized by individuals using the seating device. Holes 32 are provided within the bottom of the tray to provide for necessary drainage. The tray may be attached in any number of ways to the end wall 21 of the platform 15. As shown in FIGS. 15–17, the tray may include studs 31A which are receivable within slots 31B formed in the end wall 21.

The platform 15 also includes an elongated slot 34 therein which extends generally along a longitudinal axis A—A thereof from an enlarged opening 35 spaced intermediate the end portions 16 and 17 to an end 36 spaced adjacent the end portion 16. The slot defines a guide track for a seat 37 which is slideably mounted on the platform 15, as will be described in greater detail.

Figure 8:
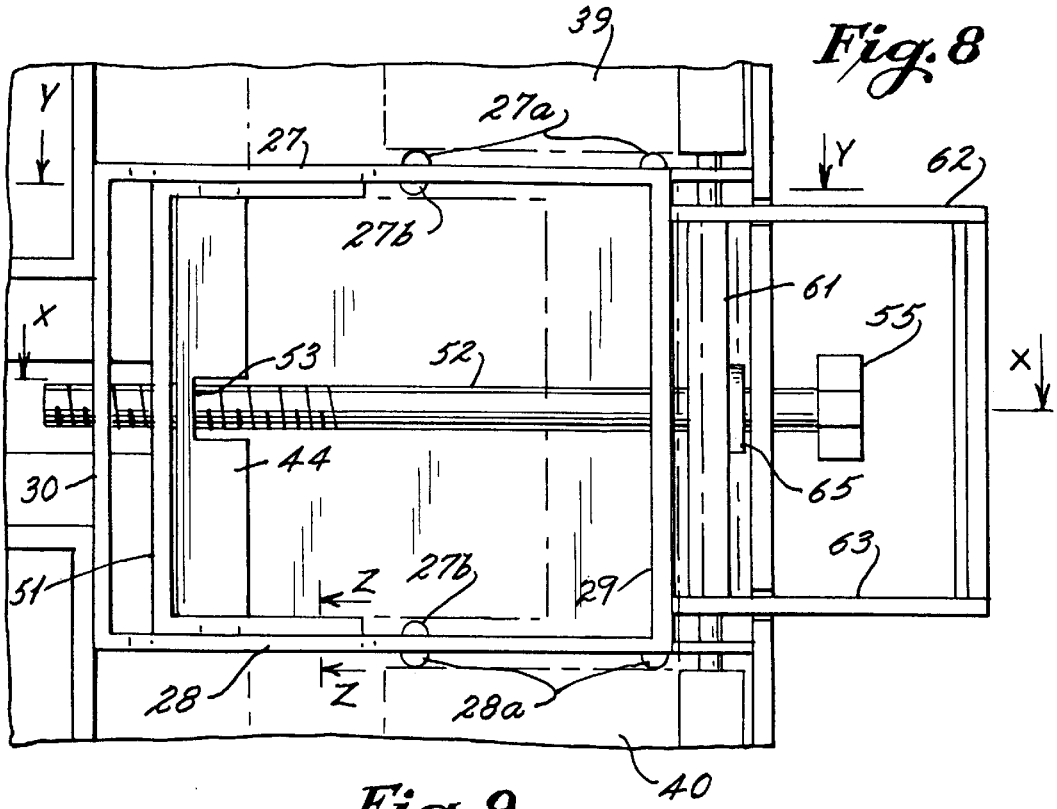
FIG. 8 is an enlarged bottom plan view of the clamp assembly of the invention.
Figure 9:
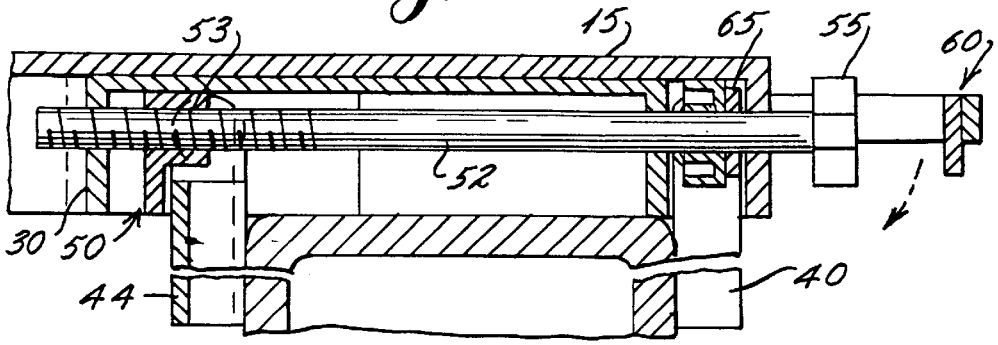
FIG. 9 is a cross-sectional view taken along line X—X of FIG. 8.

To secure the platform 15 to the sidewalls of a tub, a clamp mechanism or assembly 38 is provided adjacent the housing 36. The clamping mechanism includes a pair of outer clamp members 39 and 40 which are spaced from one another and which are pivotably mounted about pivot rods 42 and 43 which are secured to the sidewalls 18 and 19 and webs 27 and 28 adjacent to the front wall of the platform 15. The members may be pivoted from a stored position, as shown in FIG. 4, where the members underlie the platform 15 to a deployed position, as shown in FIGS. 1 and 3, where the inner surface of each member is engageable with the front surface 12*a* of sidewall 12 of the bathtub. In this position, the sidewalls 18 and 19 and the web walls 27 and 28 rest against an upper wall 12*b* of the bathtub. The clamp members 39 and 40 are pivotable relative to the platform 15 but are otherwise not moveable with respect thereto. As shown in FIG. 8, the clamp members are retained in a stored position beneath the platform by friction tabs 27*a* and 28*a* molded to the webs 27 and 28. In some embodiments only a single outer claim member may be used.

With specific reference to FIGS. 4 and 8–11, to provide an opposing clamping force, a central clamp member 44 is pivoted by stub shafts 45 and 46 to opposing sidewalls 47 and 48 of a generally C-shaped slider 50. The member includes a rear wall 51 having a threaded opening 53 there through in which an adjustment screw 52 extends. The adjustment screw extends forwardly through openings in housing member 29 and the front wall 20 of the platform. The screw is connected to an operating knob 55 which is used to rotate the screw to move the slides 50 forwardly and rearwardly carrying with it the clamp member 44. In this manner, the clamp member 44 may be moved relative to or away from the front clamp members 39 and 40 to thereby clamp the platform to the front wall of the bathtub. It should be noted that the clamp member 44 includes a cut-out 56 adjacent to the central portion thereof to provide clearance for the adjustment screw 52 so that the clamp member 44 can pivot from a fully stored position underlying the platform 15, as shown in FIG. 4, to a deployed and vertically depending extended position as shown in FIGS. 1 and 3. When the adjustment clamp 44 is in the deploy position, by adjusting the screw 52 utilizing the knob 55, a clamping action is creating by the central clamp member 44 against the inner surface 12*c* of the tub wall 12 and the outer clamp members 39 and 40 against the inner surface 12*a*. The clamp member 44 is retained in a stored position by friction tabs 276, see FIG. 8.

Figure 14:
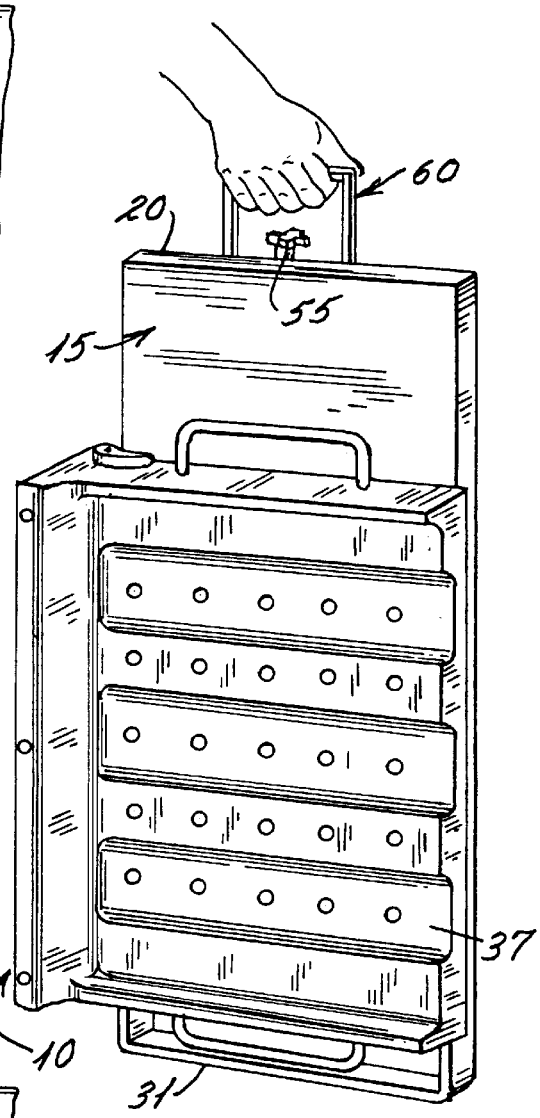
FIG. 14 is an illustrational view of the invention in a collapsed and transportable position.
Figure 6:
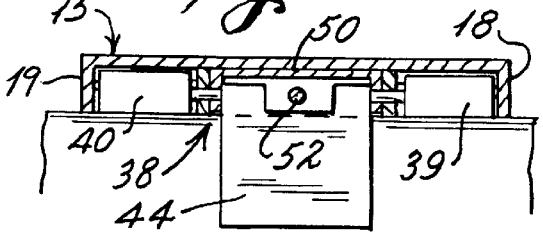
FIG. 6 is a partial cross-sectional view taken along line D—D of FIG. 3.
Figure 7:
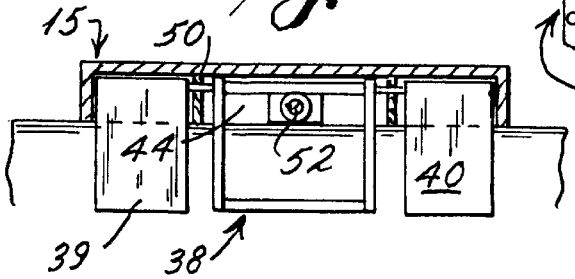
FIG. 7 is a partial cross-sectional view taken along line E—E of FIG. 3.
Figure 7A:
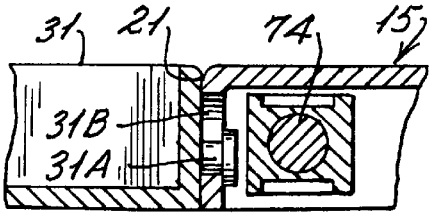
FIG. 7A is a partial cross-sectional view taken along line B—B of FIG. 4.
Figure 10:
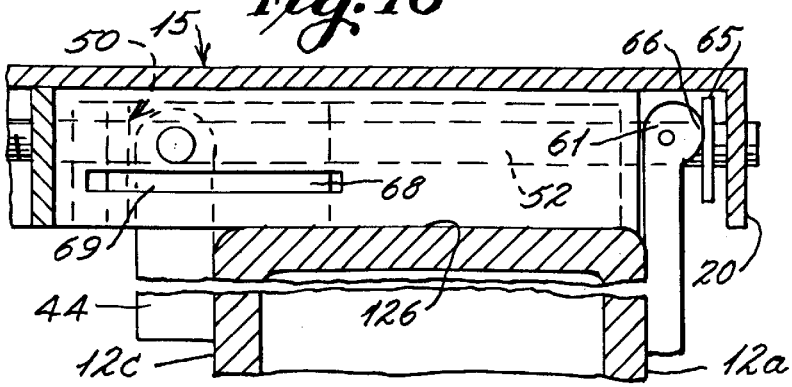
FIG. 10 is a cross-sectional view taken along line Y—Y of FIG. 8.

In order to facilitate portability and to also provide a further means for securely clamping the bath seat to the wall of the bathtub, a carrying handle 60 is connected to an elongated cam shaft 61. The handle includes side portions 62 and 63 which are connected to stub shafts of the cam shaft such that the handle may be pivoted to a downward locking position, as shown in FIG. 10, from a deployed position utilized for carrying, as shown in FIGS. 8 and 14.

Figure 11:
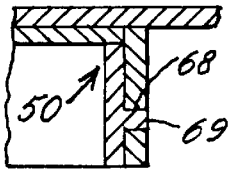
FIG. 11 is a partial cross-sectional view taken along line Z—Z of FIG. 8.

To facilitate the clamping action of the assembly 38 to securely mounted the bath seat to the side wall of the bathtub, the adjustment screw 52 has a collar 65 fixedly secured thereto adjacent to, and engageable by, the cam shaft 61. The cam shaft includes a protruding curved camming surface 66 which is forced against the collar when the handle is pivoted from the deployed position of FIG. 8 to a stored position of FIG. 10 as shown by the arrow in FIG. 9. As the cam engages the collar, the adjustment screw 52 is to forced toward the front of the platform thus pulling the U-shaped slider 50 and clamp 44 forward to thereby apply locking pressure on opposite sides of the sidewall 12 of the bathtub. Such locking of the clamp member allows a firm pressure to be applied by the clamping member after the knob 55 is used to obtain a close fit between the clamping members and the sidewall 12. As shown in FIG. 11, the slider 50 mounted within the housing 36 is further prevented from lateral movement by providing slots 68 in the web walls 27 and 28 in which guide tabs 69 from the C-shaped slider extend.

To support the inner portion of the bath seat of the present invention, the platform 15 carries a leg assembly including a pair of legs 70 and 71 which are connected at their upper ends 72 and 73, respectively, by a shaft 74. The legs are designed to be mounted to the platform adjacent to the rear end thereof so as to be spaced inwardly from the inner sidewall 11 of the bathtub. In this respect, the legs may be utilized to support the bath seat even if there is not a sufficient ledge on the inner wall 11 of the bathtub to provide support for the inner end portion of the platform.

Figure 5:
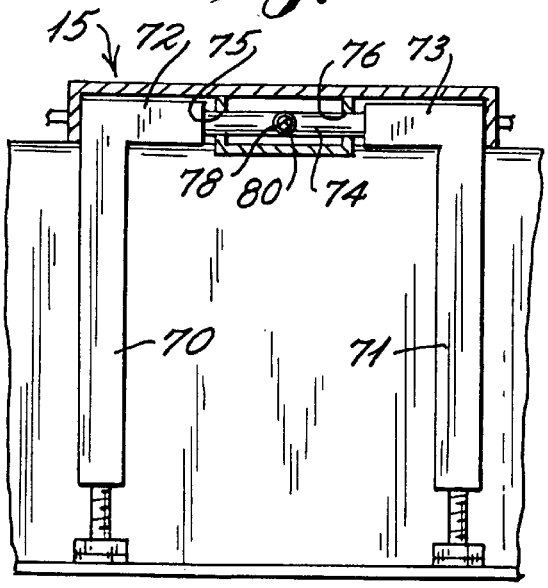
FIG. 5 is a partial cross-sectional view taken along line C—C of FIG. 3.

As shown in FIGS. 3–5, the shaft 74 of the leg assembly extends through openings 75 and 76 formed in the web walls 23 and 24 of the housing 26. The legs 70 and 71 may be integrally formed or may be separately molded and connected to the shaft 74. A pair of openings 77 and 78 are provided through the shaft 74 and generally centrally thereof and at 90° with respect to one another for purposes of receiving a locking pin 80 which extends through a flange 81 defining a front wall of the housing 26. The handle 60 includes an inner stop 82 which is engaged by a spring 83 mounted within the housing 26 which normally forces the handle to a closed or locked position, as shown in FIG. 3, where the locking pin prohibits rotation of the shaft 74. In FIG. 3, the legs 70 and 71 are shown as pivoted to support the bath seat relative to a bottom wall "B" of the bathtub. To adjust for the depth of the bottom wall, each of the legs 70 and 71 includes a threaded extension 85 having a footpad 86 to prevent marring of the tub surface. When it is desired to collapse the legs relative to the platform, the locking pin 80 is pulled outwardly against the spring 83 and, thereafter, the legs pivoted into underlying relationship with respect to the platform such that the pin aligns with the opening 79 in the shaft 74 so that the pin, when released, engages within the opening 79 to thereby lock the legs in a stored or collapsed position, as shown in FIG. 4 of the drawings.

As previously discussed, the present invention incorporates a seat 37 which is slidably mounted on the upper surface of the platform 15. The seat includes a base 90 having a plurality of fluid draining opens 91 therein. The base may have a flat upper surface or contoured upper surface with the contoured surface being shown in the drawing figures. The base is integrally formed with a small backrest portion 92. Handles 93 are provided at opposite ends of the base which may utilized to manipulate the seat and also to provide support for an individual situated on the seat. Holes in the backrest may be used for supporting an extended backrest.

Figure 2:
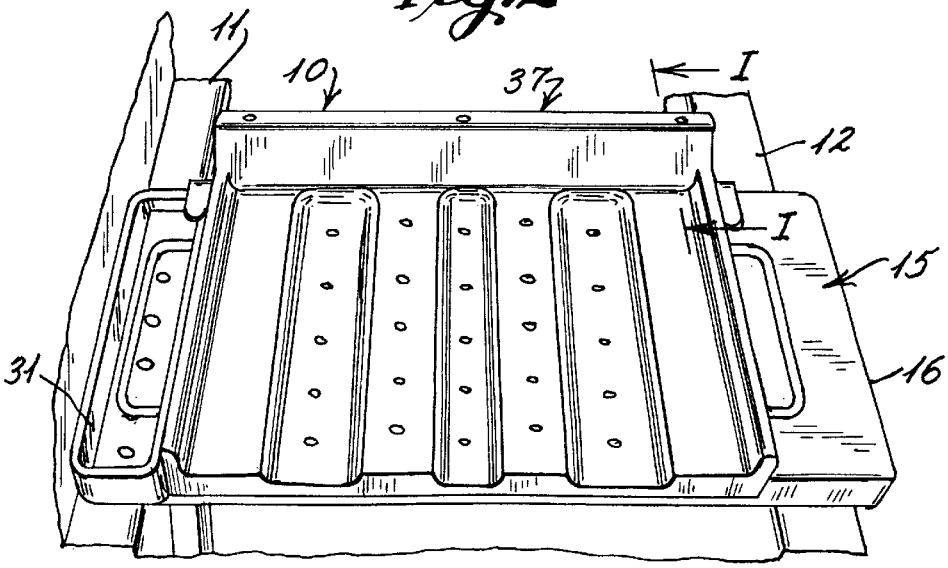
FIG. 2 is a partial side perspective view of the bath seat of FIG. 1 showing the seat pivoted to a different position centrally of the platforms.

As shown in the drawings, the seat is designed to rotate relative to the platform. In this respect, in FIG. 1, the seat is shown as being at an outermost position wherein the seat is generally above and slightly cantilevered outwardly from the outer sidewall 12 of the bathtub. In this position, the seat may not be rotated relative to the platform and the seat is oriented to facilitate a person being seated. Once seated, the seat is designed to be urged to the center of the platform where the seat may be rotated 90 degrees to the position shown in FIG. 2.

With particular reference to FIG. 12, the underside of the seat bottom is reinforced by a plurality of longitudinally and transversely ribs 94 and 95. Adjacent the center of the seat bottom are two studs 96 having openings for receiving appropriate fasteners. A seat retainer slide block 100 is provided on the bottom side of the platform 15 and includes an enlarged head or flange 101 of a size to prevent the block from passing through the opening 35 and slot 34 in the platform. An oblong stem 102 extends upwardly from the head so as to pass through the slot 34 and the opening 35 in the platform. A pair of openings 103 are provided in alignment with openings in the studs 96 in the base of the seat so that fasteners, such as screws, may be utilized to secure the block to the studs thereby mounting the seat to the platform. Because of the oblong configuration of the stem 102, when the block is positioned in the opening 35 in the platform, the seat may be rotated freely. However, when the seat is to be moved outwardly along the platform, the seat is rotated so that the oblong stem fits within the slot 34 thereby allowing the seat to be moved only longitudinally relative to the axis A—A of the platform. The oblong stem 102 will prevent rotation of the seat while deployed within the slot 34 thus insuring stability of the seat during use.

The seat 37 is supported on a plurality of plastic ball bearings 110 which are mounted within sockets 112 which are molded between the reinforcing flanges 94 and 95 in the bottom of the seat. Although 12 roller bearings are shown for supporting the seat in drawing FIG. 12, the number and their disposition may be varied.

Figure 18:
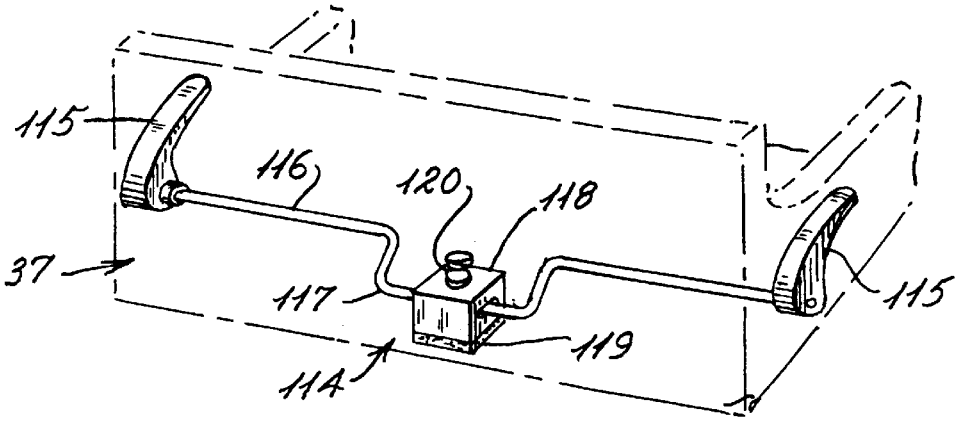
FIG. 18 is a perspective view of an optional seat brake mechanism of the invention.

The seat may also incorporate a friction brake which retains the seat in an adjusted position relative to the platform 15, see FIG. 18. The brake is shown generally at 114 and includes a pair of handles 115 mounted on opposite sides of the seat base which are mounted to the ends of a pivot rod 116 which extends through openings through the sides of the seat base. The central portion of the rod 116 is generally U-shaped at 117 and extends through a plastic block 118 to which is secured a rubber friction brake pad 119 which is engageable with the upper surface of the platform. The brake is normally applied under the influence of a spring 120 which extends to the base of the seat. The spring normally urges a central portion of the U-shaped element downwardly so as to apply the brake against the upper surface of the platform. To release the brake, the handles are pivoted upwardly thereby pivoting the brake rod 116 upwardly against the spring and raising the plastic block which supports the brake pad. Upon release of the handles 115, the brake is automatically applied to prevent further shifting of the seat relative to the base.

Figure 19:
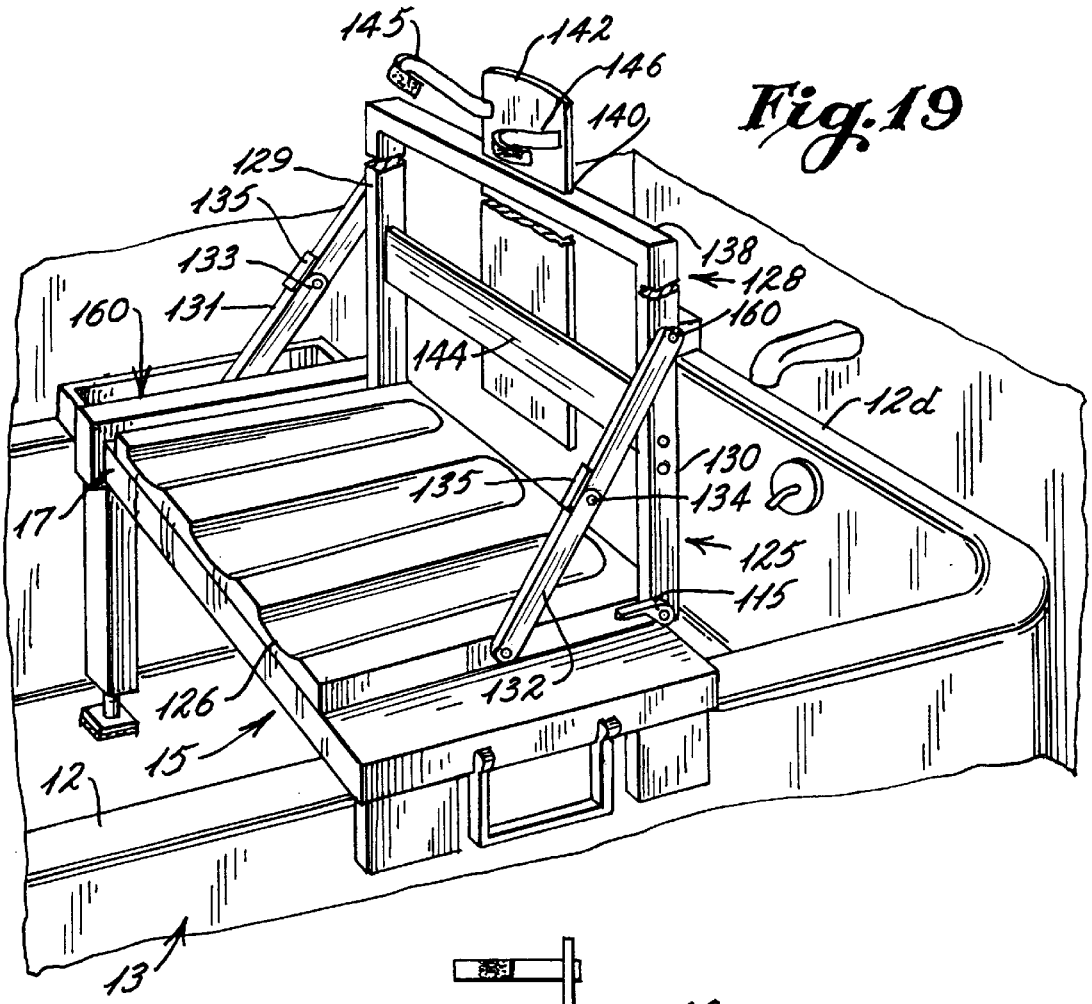
FIG. 19 is a perspective illustrational view of an alternate embodiment of seat used with the invention.
Figure 20:
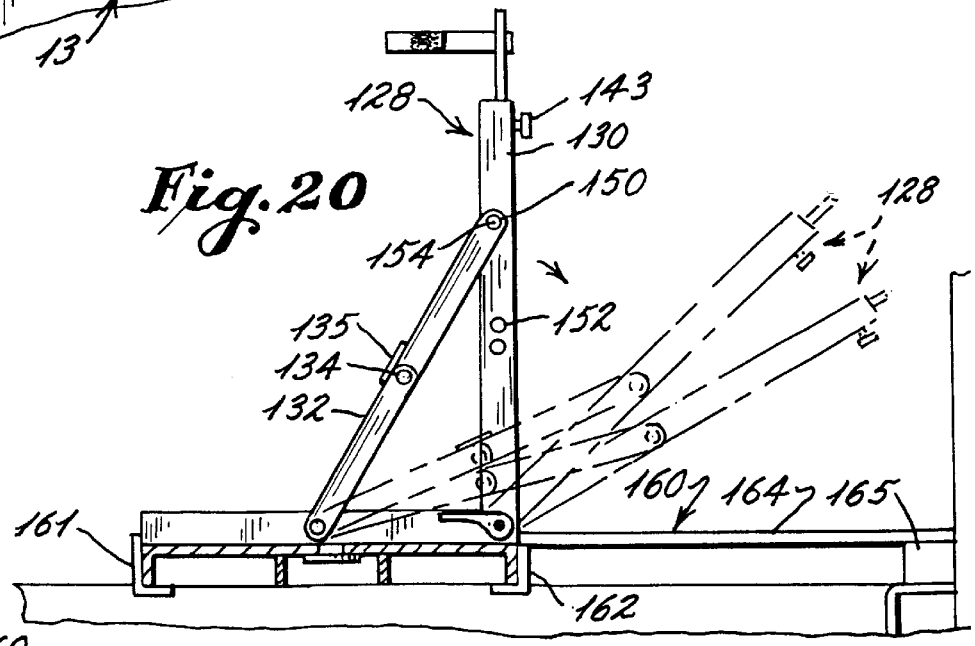
FIG. 20 is a partial side view of the embodiment shown in FIG. 19.
Figure 21:
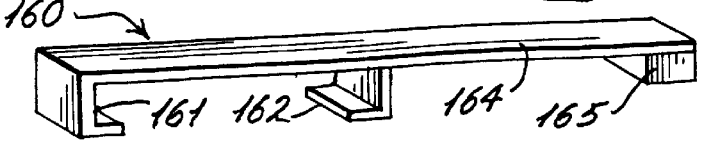
FIG. 21 is a perspective view of a reinforcement bracket used with the embodiment of FIG. 19.
Figure 22:
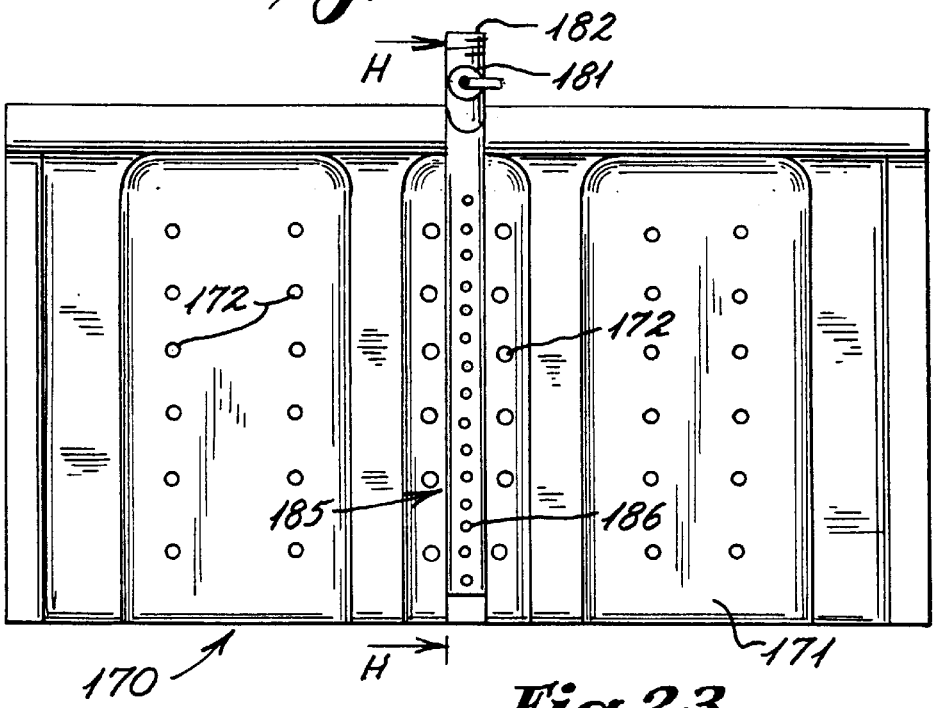
FIG. 22 is a top-plan view of a bidet-like attachment for use with a modified bath seat of the invention.
Figure 23:
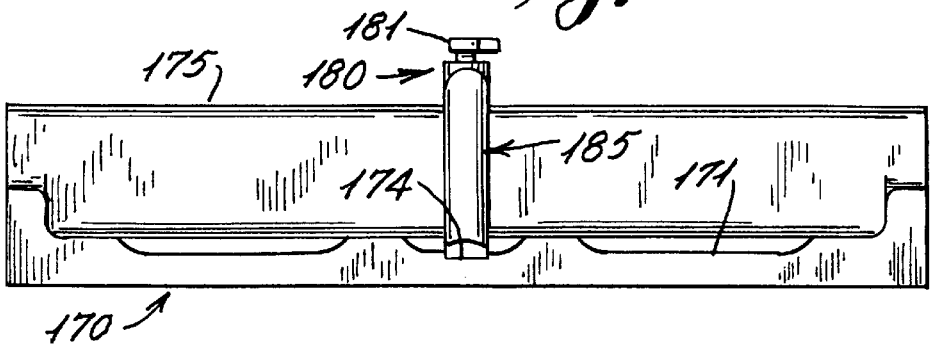
FIG. 23 is a front plan view of the bidet device of FIG. 22 shown mounted within the modified seat utilized with the present invention.
Figure 24:
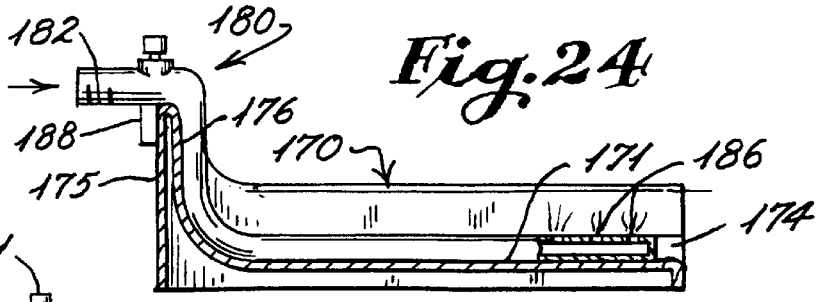
FIG. 24 is a cross-sectional view taken along line H—H of FIG. 22.
Figure 25:
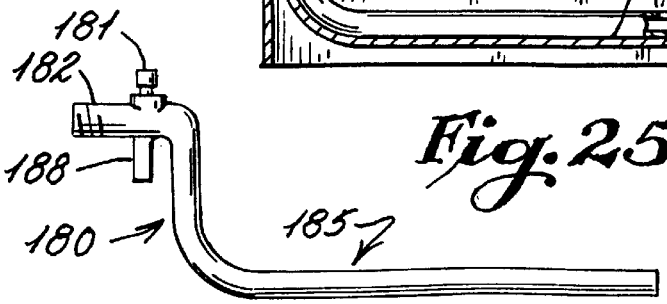
FIG. 25 is a side view of the bidet device shown removed from the seat of FIG. 22.

To the reference to FIGS. 19–21, a different embodiment of seat is disclosed for use with the platform 15 of the present invention. In this embodiment, the seat is designed specifically for use for individuals who must have positive back and head support when utilizing the bath seat. The structure of the platform 15, the clamping mechanisms and the support legs are identical to the previous embodiment. The modified seat 125 includes a base 126 which is mounted on roller bearings as previously discussed. Also, as with the previous embodiment, a break mechanisms controlled by a handle 115 may also be provided for securing the seat in an adjusted position, as shown in FIG. 19. The seat 125 includes a backrest 128 defined by a frame having side members 129 and 130 each of which are pivotally mounted at the rear of the base 126. The side members 129 and 130 are reinforced and supported by foldable struts 131 and 132 each of which are pivoted at their central portion 133 and 134, respectfully. A pivot stop 135 is provided at each pivot joint 133 and 134 for purposes of limiting the pivotal movement between the two components of each strut assembly. As shown, the strut assembly may be folded so that the backrest 128 will overlay the base 126 in a generally parallel relationship therewith when in a stored position but may be readily extended when the backrest 128 is pivoted to the raised position, as shown in FIG. 19. The backrest further includes an upper horizontal support member 138 which is integrally formed with the side members 129 and 130 and which includes a general central slot 140 therein. A headrest 142 is slidably inserted within the slot 140 and is stabilized at its lower end by a cross brace 144 which extends between the side members 129 and 130. The headrest 142 is designed to be elevated relative to the backrest to a proper position so that an individual's head may be supported thereby. The headrest is locked in place by thread lock 143. Thereafter, an individual's head is secured thereto by straps 145 and 146. The straps may include cooperating hoop and loop fabric material fasteners, such as Velcro™, for purposes of securing the straps tightly about an individual's forehead and thereby provide lateral stability for the head and neck when using the bath seat.

The present embodiment is also design for a patient to be reclined. In this respect, and is shown in FIG. 20, each of the vertical members 129 and 130 includes a plurality of openings therethrough as shown generally at 150 and 152. Any number of spaced openings may be provided for purposes allowing adjustment of the backrest, as shown in dotted lines in FIG. 20. Each strut assembly includes an opening in the upper end thereof through which a locking pin 154 is selectively inserted in order to retain the backrest 128 at a desired angle of inclination.

To provide additional lateral support for the bath seat of the embodiment shown in FIGS. 19 and 20, the present embodiment includes a supplemental support bracket 160, as shown in FIG. 21. The bracket includes a pair of opposing clamp elements 161 and 162 which are designed to be slidingly engaged over the inner end portion 17 of the platform 15. The backrest further includes a cantilevered portion 164 which extends outwardly from the side wall of the platform 15 to an end block 165 which is designed to seat against an end wall 12*d* of the bathtub 13. In this manner, and as shown in FIG. 20, as the backrest 128 is inclined, more weight is shifted outwardly from the platform 15. Under these circumstances, the support 160 will stabilize the platform and seat and prevent any shifting thereof relative to the upper walls of the bathtub.

With specific reference to FIGS. 22–25, another modified seat configuration 170 is disclosed. In this embodiment, the base of the seat 171 is shown as having a plurality of drain holes 172 therethrough and a recess 174 provided in a central portion thereof. The modified seat further includes a backrest 175. A depression or recess 176 is also formed within the backrest which is in alignment with the depression or recess 174 in the base of the seat. The remaining portions of the seat and the manner in which it is mounted to the platform 15 is identical to that discussed above with respect to the previous embodiments. In the present embodiment, a supplemental attachment may be utilized to provide water to the area of the base of the seat to facilitate cleansing in the manner of bidet. As shown, the bidet fixture 180 includes a valve 181 for controlling a fluid inlet 182 by way of which water is introduced to a somewhat L-shaped tube or sprayer 185. The sprayer extends along and is friction fitted within the recesses in the back and in the base of the seat so as to be generally level with the surface of the back and of the base of the seat. The bidet-like device includes a plurality of openings 186 therein through which fluid is discharged. To retain the cleansing device on the seat, a depending lip 188 is provided for engaging the back of the seat. Utilizing the device shown in FIGS. 22–25, cleaning fluid may be provided for cleansing the buttocks and genital areas of a patient in the manner of a conventional bidet. The cleansing device may be removed when not in use and easily stored.

With particular reference to FIG. 14, the bath seat of the present invention is designed to be readily portable and, in this respect, is easily hand carried. To carry the device, the seat 37, 125, or 170 is placed in a central portion of the platform 15. The brake mechanism will retain the seat in a locked position as shown in the drawing figure. The leg assembly including the legs 70 and 71 is pivoted by first releasing the locking pin 80 against the spring and thereafter pivoting the legs into an underlying position relative to the platform. The locking pin 80 is thereafter released locking the legs into the stored position. Thereafter, and the carrying handle 60 is pivoted outwardly to a toting position, as shown in the drawing figure, and the clamps 39, 40 and 44 are pivoted to their stored position beneath the forward portion of the platform.

We claim:

1. A portable bath seat for use with a bathtub having an outer wall defining an upper ledge, an inner wall and a bottom wall, the portable seat comprising:

a platform having first and second ends, clamping means pivotally mounted to a lower surface of said platform adapted to clampingly engage opposite surfaces of an outer side wall of a bathtub therebetween adjacent said first end of said platform, a leg assembly pivotally mounted to said lower surface of said platform adjacent said second end thereof, said leg assembly being pivotable from a first stored position generally beneath and parallel to said platform to a second deployed position generally perpendicular to said platform, locking means for selectively securing said leg assembly in said first and second position, a seat, means for mounting said seat relative to an upper surface of said platform so that said seat is moveable from a first position adjacent to said first end of said platform to a second position spaced toward said second end of said platform, said means for mounting said seat to said platform includes an elongated slot along said platform which extends from adjacent said first end to a central portion of said platform to an opening, a locking member extending through said slot and being of a size to be rotatable within said opening but being non-rotatable within said slot whereby said seat may be rotated when said locking member is within said opening but is non-rotatable when said seat is moved so that said locking member is within said slot, and said means for mounting said seat including a plurality of bearing means extending between said seat and said upper surface of said platform.

2. The portable bath seat of claim 1 wherein said locking member includes a slide block having an enlarged head having an oblong shaft extending upwardly therefrom of a size to be slideably received within said slot but being non-rotatable with respect to said slot, and said head being of a size to prevent passage of said locking member through said opening in said platform.

3. The portable bath chair of claim 1 wherein said leg assembly includes first and second leg members connected by a central shaft, a pair of openings in said central shaft for receiving said locking means when said leg assembly is in said first position and said second position.

4. The portable bath chair of claim 3 including vertical adjustment means mounted to each of said first and second leg member for selectively adjusting the height of said first and second leg members so as to be adapted to engage the bottom wall of the bathtub.

5. The portable bath seat of claim 1 in which said clamping means includes at least one outer clamp member adapted to engage an outer surface of the outer wall of a bathtub and which is movable from a first stored position generally parallel to and beneath said platform to a second deployed position extending generally perpendicularly with respect thereto and at least one inner clamp member adapted to be selectively engageable with an inner surface of the outer wall of a bathtub and being moveable from a first stored position generally parallel and beneath said platform to a second position generally perpendicularly with respect thereto, and means for adjusting the spacing between said at least one first and second clamp members to thereby cause them to clampingly engage on opposite surfaces of the outer wall of a bathtub.

6. The portable bath seat of claim 5 including a pair of spaced outer clamp members, each of said outer clamp members being pivotable from said first stored position generally parallel to and beneath said platform to a second deployed position generally perpendicularly with respect thereto.

7. The portable bath seat of claim 5 including a handle pivotable mounted adjacent said first end of said platform and being pivotable from a first position beneath said platform to a second position extending outwardly and generally parallel with respect to said platform.

8. The portable bath seat of claim 7 wherein said means of adjusting the spacing of said at least one inner and outer clamp members includes a slider member slidingly mounted relative to a lower surface of said platform, an adjustment screw thoroughly engaging said slider member and extending from said front end of said housing to an adjustment knob, and said inner clamp member being pivotally carried by said slider member.

9. The portable bath seat of claim 8 in which said screw includes an abutment member, a cam member pivotally engageable with said abutment member, and said handle being connected to said cam member whereby when said handle is pivoted from said second position to said first position said cam member engages said abutment member thereby urging said screw and said at least one inner clamp member toward said at least one outer clamp member.

10. The portable bath seat of claim 1 including a support bracket, said support bracket including means for engaging said platform adjacent said second end thereof and including a portion extending outwardly from said platform and adapted to engage an end wall of a bath tub.

11. The portable bath seat of claim 10 in which said support bracket includes a pair of opposing clamp elements for slideably engaging said platform therebetween and a cantilevered member adapted to engage the end wall of the bathtub.

12. The portable bath seat of claim 1 in which said seat includes a backrest, means for adjusting said backrest so as to be inclined outwardly relative to said platform, and said backrest being moveable from a first position generally parallel with said platform to a second elevated position with respect thereto.

13. The portable bath seat of claim 12 including a headrest adjustably mounted to said backrest, and means adapted to restrain an individual's head to said headrest.

14. The portable bath seat of claim 13 including a support bracket, said support bracket including means for engaging said platform adjacent said second and thereof and including a portion extending outwardly from said platform and adapted to engage an end wall of a bath tub.

15. The portable bath seat of claim 1 including a tray adapted to be connected adjacent said second end of said platform, and means for removably connecting said tray to said second end of said platform.

16. The portable bath seat of claim 1 including a brake means carried by said seat, said brake means normally engaged with said platform to prevent movement thereof relative to said platform, and means for releasing said brake means to permit movement of said seat relative to said platform.

17. The portable bath seat of claim 1 in which said bearing means includes a plurality of sockets extending from a lower surface of said seat and roller bearings mounted within each of said sockets for engaging said upper surface of said platform.

18. The portable bath seat of claim 1 including a bidet element, and means for mounting said bidet element to said seat.

19. The portable bath seat of claim 18 in which said seat includes a base portion and a backrest, a recess formed in said base portion and a recess formed in said backrest, said bidet element being seated within said recesses of said base portion and said backrest of said seat.

20. The portable bath seat of claim 19 in which said bidet means includes an inlet means, a valve means communicating with said inlet means, and a spray member extending from said valve and having a plurality of space openings therein.

21. A portable bath seat for use with a bathtub having an outer wall defining an upper ledge, an inner wall and a bottom wall, the portable seat comprising:

a platform having first and second ends, clamping means pivotally mounted to a lower surface of said platform adapted to clampingly engage opposite surfaces of an outer side wall of a bathtub therebetween adjacent said first end of said platform, a leg assembly pivotally mounted to said lower surface of said platform adjacent said second end thereof, said leg assembly being pivotable from a first stored position generally beneath and parallel to said platform to a second deployed position generally perpendicular to said platform, locking means for selectively securing said leg assembly in said first and second position, a seat, means for mounting said seat relative to an upper surface of said platform so that said seat is moveable from a first position adjacent to said first end of said platform to a second position spaced toward said second end of said platform, said means for mounting said seat including a plurality of bearing means extending between said seat to said upper surface of said platform, said clamping means including at least one outer clamp member adapted to engage an outer surface of the outer wall of a bathtub and which is movable from a first stored position generally parallel to and beneath said platform to a second deployed position extending generally perpendicularly with respect thereto and at least one inner clamp member adapted to be selectively engageable with an inner surface of the outer wall of a bathtub and being moveable from a first stored position generally parallel and beneath said platform to a second position generally perpendicularly with respect thereto, and means for adjusting the spacing between said at least one first and second clamp members to thereby cause them to clampingly engage on opposite surfaces of the outer wall of a bathtub, and including a handle pivotable mounted adjacent said first end of said platform and being pivotable from a first position beneath said platform to a second position extending outwardly and generally parallel with respect to said platform.

* * * * *